US009777495B2

(12) United States Patent
Moody

(10) Patent No.: US 9,777,495 B2
(45) Date of Patent: Oct. 3, 2017

(54) FLOW-THROUGH POOL COVER

(71) Applicant: Russell P Moody, Smyrna, TN (US)

(72) Inventor: Russell P Moody, Smyrna, TN (US)

( * ) Notice: Subject to any disclaimer, the term of this patent is extended or adjusted under 35 U.S.C. 154(b) by 86 days.

(21) Appl. No.: 14/936,741

(22) Filed: Nov. 10, 2015

(65) Prior Publication Data

US 2016/0130828 A1 May 12, 2016

Related U.S. Application Data

(60) Provisional application No. 62/078,847, filed on Nov. 12, 2014.

(51) Int. Cl.
*E04H 4/10* (2006.01)

(52) U.S. Cl.
CPC ..... *E04H 4/10* (2013.01)

(58) Field of Classification Search
CPC .. E04H 4/08; E04H 4/10; E04H 4/101; E04H 4/103; E04H 4/105; E04H 4/106; E04H 4/108
USPC ..... 4/498, 503
See application file for complete search history.

(56) References Cited

U.S. PATENT DOCUMENTS

| | | | | |
|---|---|---|---|---|
| 3,579,657 | A * | 5/1971 | Gurrieri | E04H 4/10 210/474 |
| 5,713,087 | A | 2/1998 | Maggion | |
| 5,722,098 | A | 3/1998 | Stern | |
| 5,802,629 | A * | 9/1998 | Zietek | E04H 4/10 4/496 |
| 5,946,743 | A * | 9/1999 | Hashmi | E04H 4/10 4/496 |
| 6,260,217 | B1 * | 7/2001 | Loft, Jr. | E04H 4/10 4/498 |
| 7,065,804 | B2 | 6/2006 | Rickman | |
| 2005/0172390 | A1 * | 8/2005 | Rickman | E04H 4/10 4/498 |

* cited by examiner

*Primary Examiner* — J. Casimer Jacyna

(57) ABSTRACT

A flow-through pool cover that efficiently drains built up water from the top of the pool cover while simultaneously preventing leaves and twigs from entering the pool and or clogging up the draining device. The flow-through pool cover includes a pool cover, a plurality of drain-receiving holes, and a plurality of drains. The drain-receiving holes traverse through the pool cover and are distributed about the pool cover. Each of the drains includes a base plate, a plurality of drain holes, a tubular body, and a fastening mechanism. The drain holes are distributed about the base plate and traverse through the base plate to create a mesh. The base plate and the tubular body are concentrically positioned with a corresponding drain-receiving hole. The base plate is attached to the tubular body by the fastening mechanism through the pool cover.

11 Claims, 7 Drawing Sheets

SECTION A-A

DETAIL B

FLOW-THROUGH POOL COVER

The current application claims a priority to the U.S. Provisional Patent application Ser. No. 62/078,847 filed on Nov. 12, 2014.

FIELD OF THE INVENTION

The present invention relates generally to pool accessories. More specifically, the present invention is a pool cover with an integrated drainage system which does not require constant maintenance.

BACKGROUND OF THE INVENTION

A swimming pool is a container filled with water that allows people to engage in water-related activities such as swimming. Swimming pools date back to 2500 B.C. in cultures such as Greece, Rome, and Egypt. There is a wide variety of pool types including indoor pools, outdoor pools, hot tubs, and spa pools. Each one of these require proper care and specific maintenance to ensure product longevity and safe swimming conditions for the user. One of the main safety requirements for the majority of swimming pools is the constant internal water pressure. This means that the pool cannot be drained. This is especially important for in-ground pools as removing the water can, and most likely will, cause structural failure as the sidewalls of the pool were not designed to withstand the pressures applied by the exterior soil. As a result of this requirement, owners of swimming pools will leave water in the pool at all times of the year, even during the offseason, i.e. winter. In order to do this, a pool cover is used to prevent rain water, dirt, leaves, and other debris from contaminating the water inside the pool. Traditional pool cover provide adequate protection to the swimming pool but fall short in the removal of rain water and snow that accumulates on the cover, causing the pool cover to sag, tear, and eventually fail. There are systems available on the market which drain excess water from the top of the pool cover, but each one requires some type of maintenance as leaves clog up the piping.

The present invention protects the water inside the swimming pool from debris and excessive sunlight while simultaneously preventing the pool cover from sagging due to rain water and snow. This is achieved through a drainage system which drains only part of the water on the pool cover, leaving debris such as leaves on the cover which could potentially clog up the drainage system. Additionally, the present invention keeps a few inches of water on the pool cover in order to prevent the pool cover from flapping in the wind.

DETAIL DESCRIPTIONS OF THE INVENTION

All illustrations of the drawings are for the purpose of describing selected versions of the present invention and are not intended to limit the scope of the present invention.

The present invention generally relates to pool accessories. More specifically, the present invention is a cover for a swimming pool which includes a plurality of draining devices integrated throughout. The present invention effectively drains water from the top of the cover, thus relieving pressure being applied to cover by excess water built up over time and preventing tearing. The present invention does this while simultaneously keeping out leaves, dirt, and other similar debris from clogging up the draining devices and ending up in the pool. This is achieved by raising the inlet of the draining device above the cover, which lowers the chances that leaves and other similar debris may flow into the drain device. By preventing the debris from clogging up the draining devices, the present invention requires very little maintenance, which in turn means the user may leave the premise and the pool for long periods of time. Furthermore, the present invention ensures a small amount of residual water remains on top surface of the cover to prevent flapping in the presence of strong winds.

Figure 1:
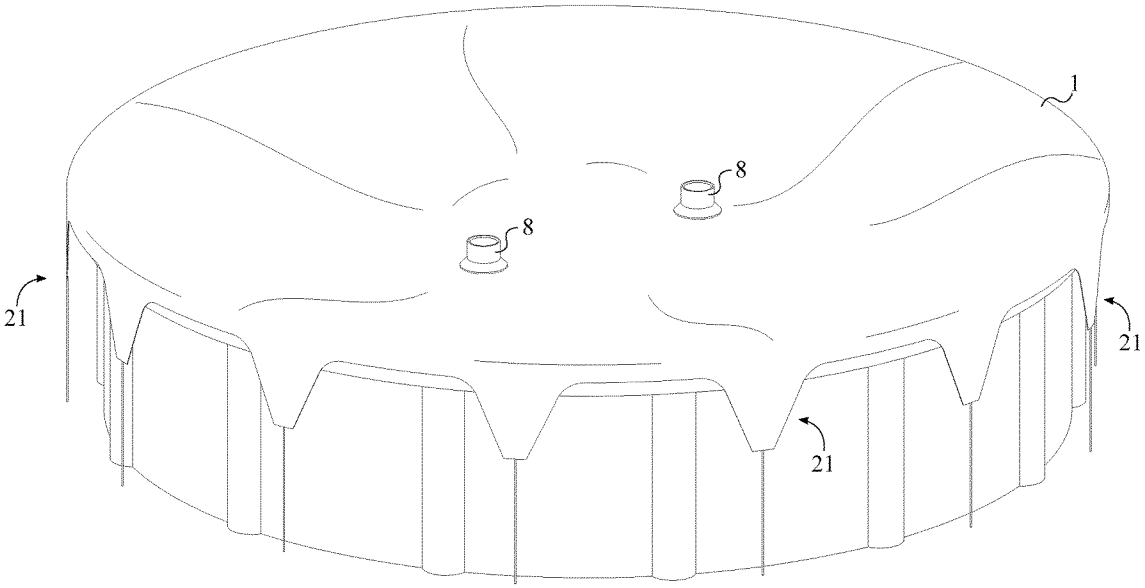
FIG. 1 is an environmental, perspective view of the present invention.
Figure 2:
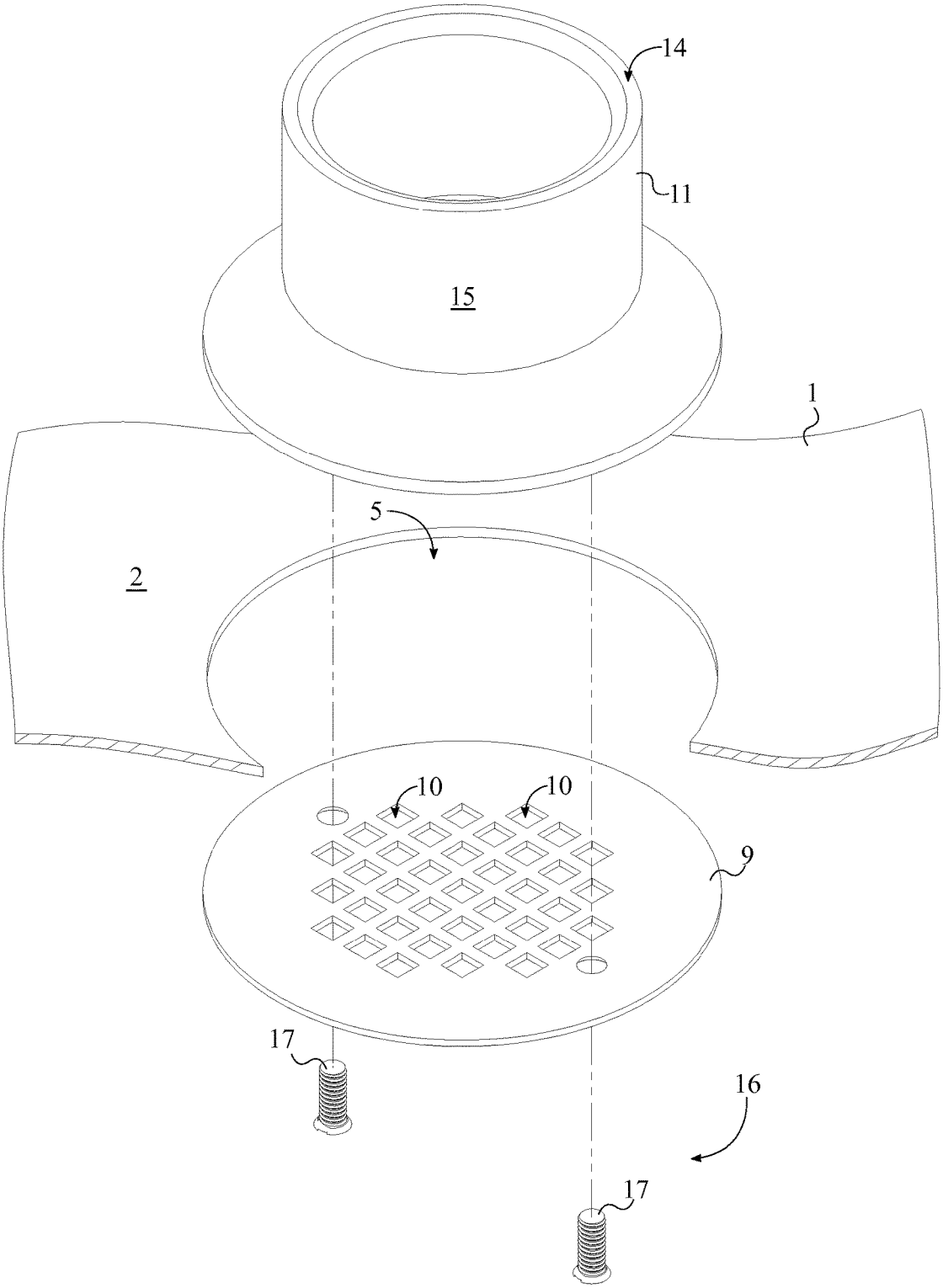
FIG. 2 is an exploded view, partial view of the present invention.
Figure 4:
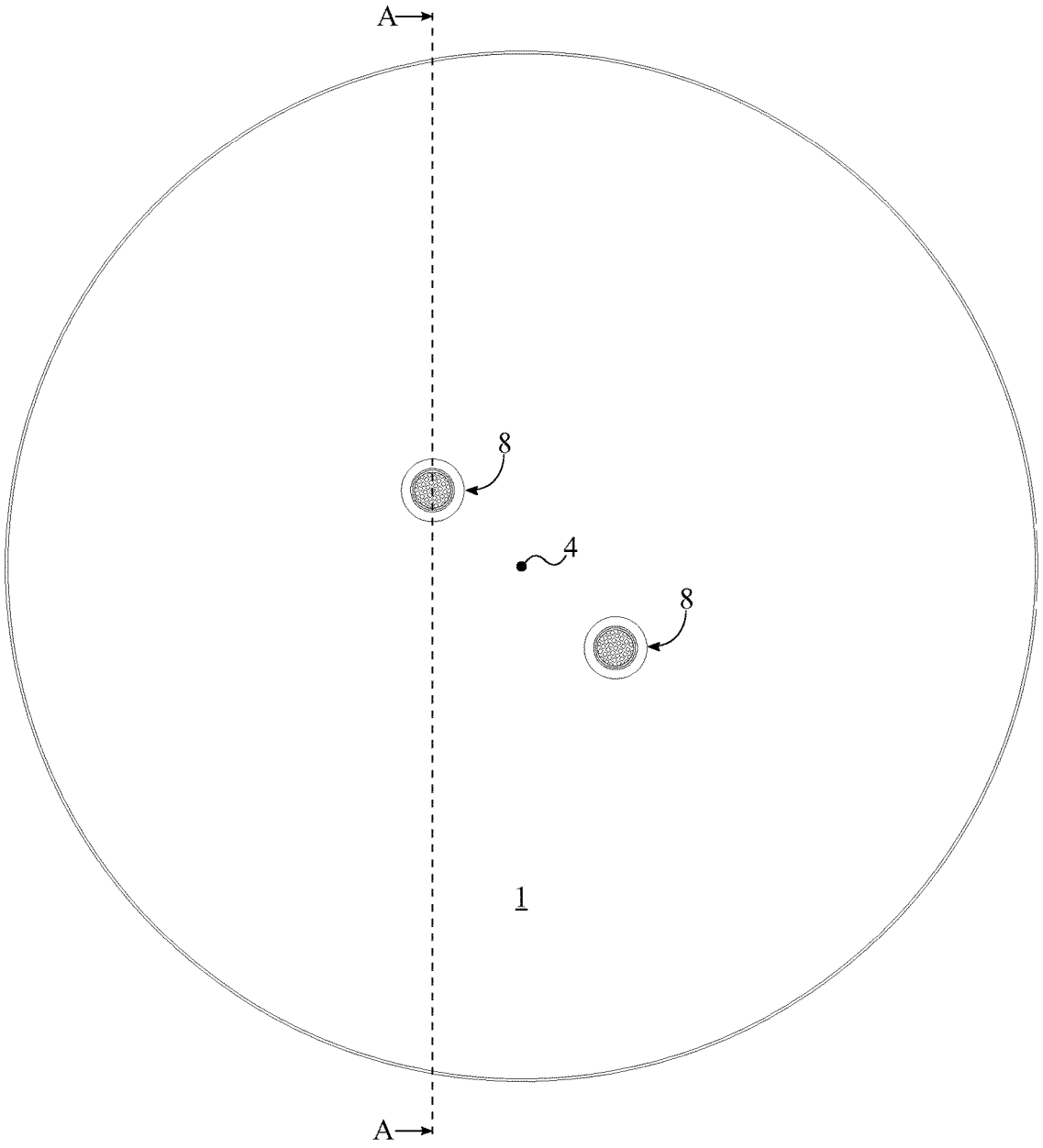
FIG. 4 is a top view of the present invention.
Figure 6:
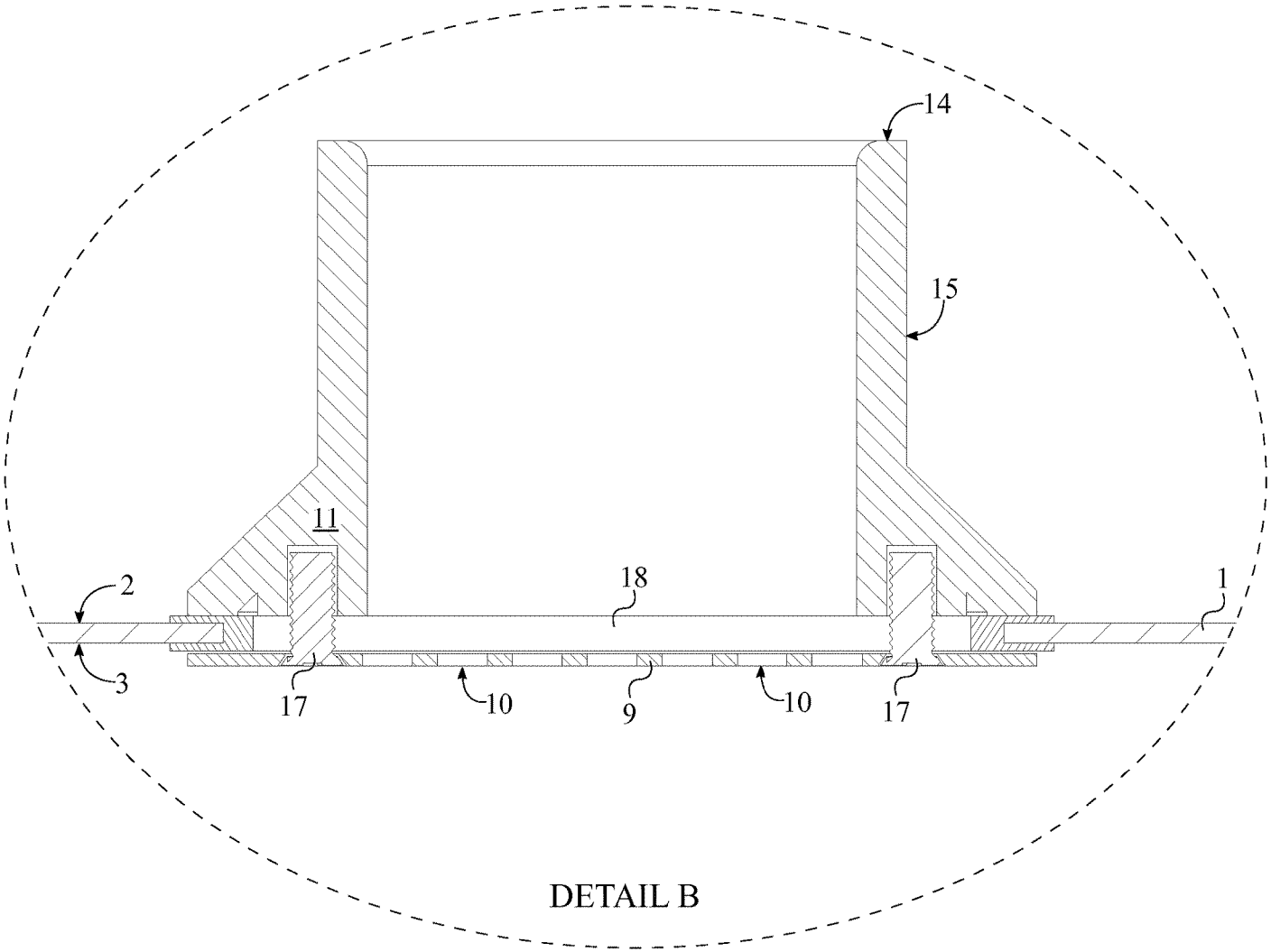
FIG. 6 is a detailed view taken about circle B in FIG. 5.

Referring to FIG. 1 and FIG. 2, the present invention comprises a pool cover 1, a plurality of drains 8, and a plurality of drain-receiving holes 5. The pool cover 1 is a physical barrier that is perimetrically attached to a pool in order to prevent leaves and debris from contaminating the water inside the pool. Additionally, and more importantly, the pool cover 1 provides a safety barrier for animals and children to prevent them from falling into the pool and possibly drowning. The pool cover 1 comprises a top surface 2 and a bottom surface 3. The top surface 2 faces the external environment while the bottom surface 3 faces the interior of the pool as seen in FIG. 6. The present invention may be integrated into a variety of different pool cover 1 designs. Pool cover 1 designs includes, but is not limited to, different shapes, material compositions, and sizes. The plurality of drains 8 collects excess water from the top surface 2 and redirects it into the pool. The plurality of drain-receiving holes 5 facilitates the placement of the plurality of drains 8 within the pool cover 1. The plurality of drain-receiving holes 5, and therefore the plurality of drains 8, is distributed across the pool cover 1 as seen in FIG. 4 with each of the plurality of drain-receiving holes 5 traversing through the pool cover 1 from the top surface 2 to the bottom surface 3. The number of drains 8 and drain-receiving holes 5 directly depend on the size of the pool cover 1 and in turn the size of the pool. A larger pool cover 1 may require multiple drains 8 and drain-receiving holes 5 to adequately and efficiently accommodate the greater surface area and vice versa. It is preferred that the plurality of drain-receiving holes 5 is radially distributed about a center 4 of the pool cover 1 to ensure adequate draining for all regions of the top surface 2.

Figure 5:
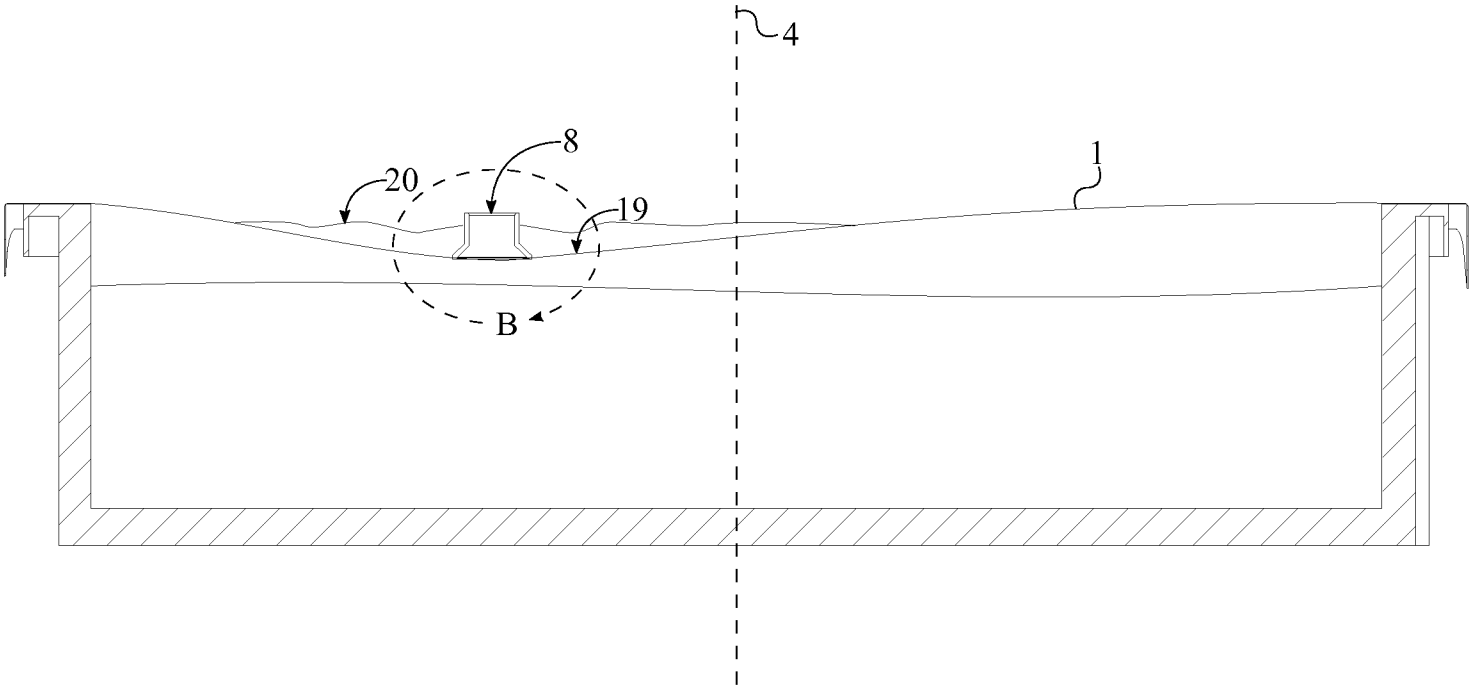
FIG. 5 is a sectional-cut view taken about line A-A in FIG. 4.
Figure 7:
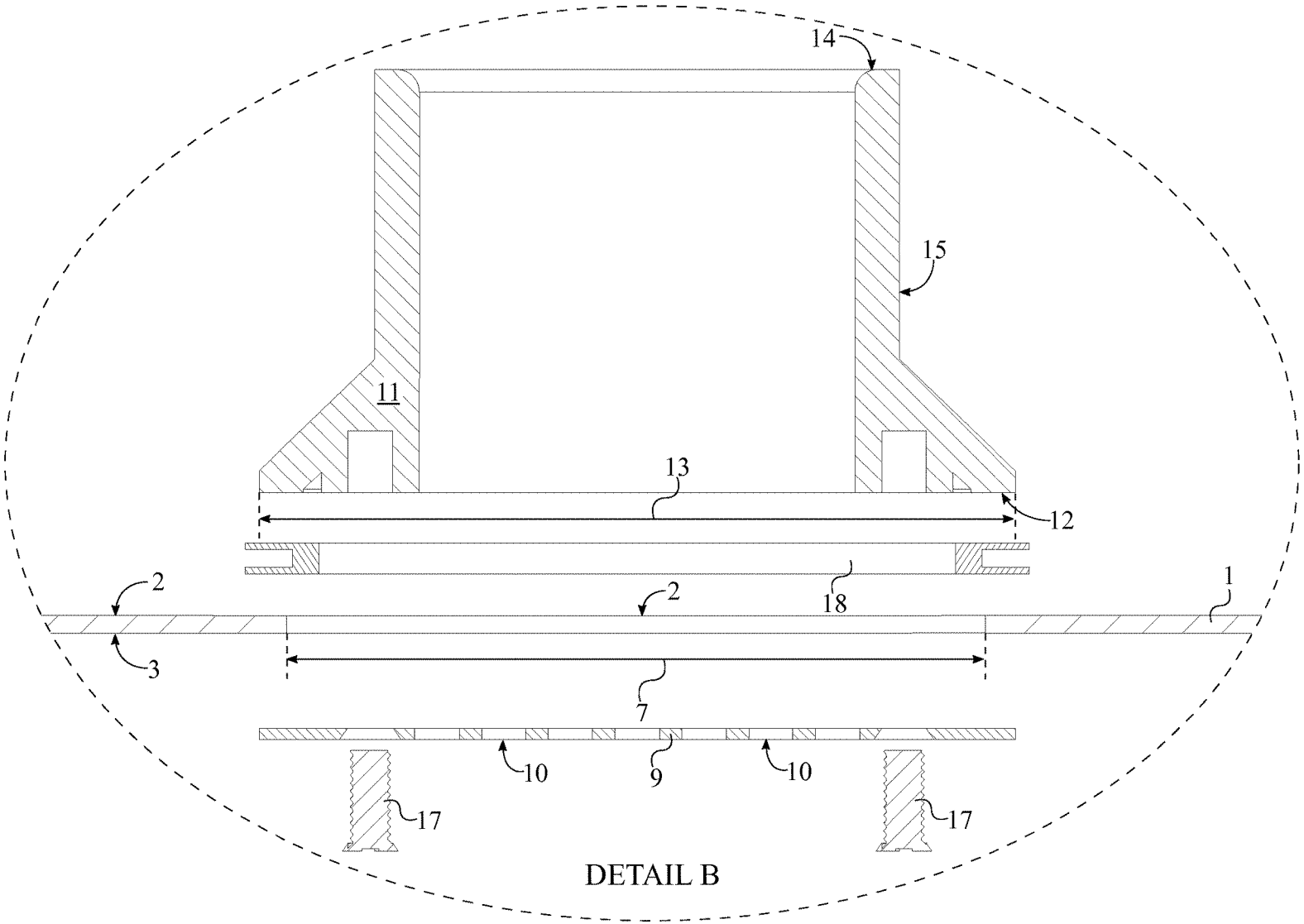
FIG. 7 is an exploded detailed view taken about circle B in FIG. 5.

Referring to FIG. 2, each of the plurality of drains 8 comprises a base plate 9, a plurality of drain holes 10, a tubular body 11, and a fastening mechanism 16. The base plate 9 in conjunction with the plurality of drain holes 10 create a physical filter which allows only water to flow through each drain 8 and into the pool. In particular, the base plate 9 and the plurality of drain holes 10 are used to prevent leaves and large debris from contaminating the pool water. The base plate 9 is shaped and sized to that of an outlet rim 12 of the tubular body 11. The plurality of drain holes 10 is distributed across the base plate 9 with each of the plurality of drain holes 10 traversing through base plate 9 as seen in FIG. 2. The size and shape of each of drain holes 10 as well as the number of the drain holes 10 may vary to increase or decrease the flow rate of each drain 8. The base plate 9 is preferably composed of rust-resistant material. The tubular body 11 prevents leaves and debris from entering each drain 8 and consequently into the pool. The tubular body 11 of each of the plurality of drains 8 is concentrically positioned with a corresponding hole from the plurality of drain-receiving holes 5. Additionally, the tubular body 11 is positioned adjacent to the top surface 2 with an inlet rim 14 of the tubular body 11 being offset from the top surface 2 as seen in FIG. 5. The base plate 9 is concentrically positioned with the tubular body 11, adjacent to the outlet rim 12. More specifically, the base plate 9 is adjacently and perimetrically positioned to the bottom surface 3, around the corresponding hole as seen in FIG. 2, thus fully covering the corresponding hole. It is preferred that a diameter 13 of the outlet rim 12 for each of the plurality of drains 8 is greater than a diameter 7 of the corresponding hole as seen in FIG. 7. The base plate 9 is attached to the tubular body 11 by the fastening mechanism 16 through the pool cover 1, compressing and trapping the pool cover 1 in between the base plate 9 and the tubular body 11. A variety of mechanisms and devices may be used for the fastening mechanism 16. This configuration attaches each of the plurality of drains 8 to the pool cover 1 and ensures that no rips or tears develop around each of the plurality of drain-receiving holes 5 over an extended period of time.

In one embodiment of the present invention, the fastening mechanism 16 comprises a plurality of screws 17. Each of the plurality of screws 17 traverses through the base plate 9 and into the tubular body 11 in order to attach the base plate 9 to the tubular body 11. The plurality of screws 17 allows a user to easily assembly and disassemble the present invention. The number of screws within the plurality of screws 17 is preferably two. Each of the plurality of screws 17 is tightened until a waterproof seal is created at the junction in between the pool cover 1, base plate 9, and the tubular body 11. Alternative means that may be used for the fastening mechanism 16 include, but are not limited to, bolts, adhesives, and interlocking mechanisms.

Figure 3:
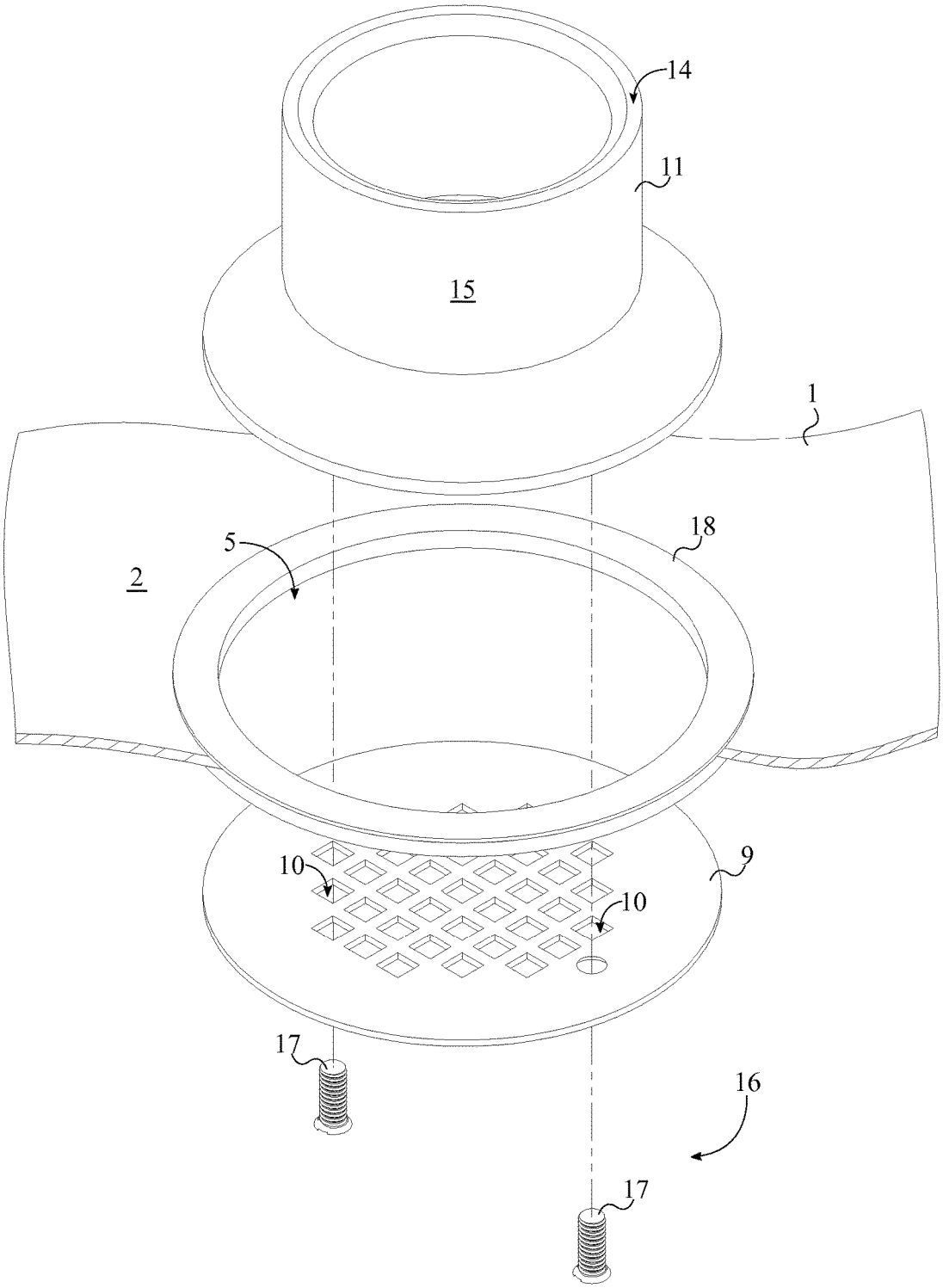
FIG. 3 is an exploded view, partial view of an alternative embodiment of the present invention.

Referring to FIG. 3, in an alternative embodiment of the present invention, each of the plurality of drains 8 further comprises a grommet 18. The grommet 18 further prevents tearing and abrasion of the pool cover 1 around the corresponding hole. The grommet 18 of each of the plurality of drains 8 is concentrically positioned with the corresponding hole. More specifically, the grommet 18 is sealingly engaged to the pool cover 1 around the corresponding hole. This may be achieved through the use of various types of adhesives, manufacturing processes, and other similar methods. The outer dimensions of the grommet 18 are preferably sized to the dimensions of the outlet rim 12 and the base plate 9 as seen in FIG. 3. The diameter of an internal groove of the grommet 18 is equal to the diameter 7 of the corresponding hole. In this embodiment, the grommet 18 is compressed in between the base plate 9 and the tubular body 11 by the fastening mechanism 16, thus attaching each drain 8 to the pool cover 1.

Referring to FIG. 1, the pool cover 1 is attached to the pool through the use of a plurality of pool fasteners 21. The plurality of pool fasteners 21 is perimetrically distributed about the pool cover 1 in an even manner to ensure that the tension in all portions of the pool cover 1 is equal. Each of plurality of pool fasteners 21 is attached to the pool cover 1 on one end and anchoring structure on the opposing end. A variety of different devices may be used for the plurality of pool fasteners 21 including, but not limited to, tension cords, nets, and cover clips. When a surrounding area 19 of the top surface 2 for each of the plurality of drains 8 is in a taught configuration, the surrounding area 19 and an outer lateral surface 15 of the tubular body 11 form a water retention region 20 around each of the plurality of drains 8 as seen in FIG. 5. The water retention region 20 holds a small volume of accumulated water in order to prevent the pool cover 1 from flapping up and down in the wind. Additionally, the water retention region 20 allows leaves and twigs to settle on the top surface 2 and only allow water to pass through the inlet rim 14 and therefore each drain 8. Any water that is passed through the plurality of drains 8 goes through the skimmer, thus keeping the water level inside the pool constant. This results in a maintenance free apparatus which the user may leave for extended periods of time.

The present invention may be implemented in two main forms, an integrated embodiment and a retrofit embodiment. In the integrated embodiment, the system of the present invention is integrated into the pool cover 1 during the design and manufacturing processes. In the retrofit embodiment, the system of the present invention is a retrofit kit that is installed into the pool cover 1 by either the user or a professional. For the retrofit embodiment, the present invention includes the plurality of drains 8 and set of instructions for installing thereof. The instructions dictates to first identifying the placement for the plurality of drain-receiving holes 5. Next, the user cuts portion of the pool cover 1 to create each of the plurality of drain-receiving holes 5. Either a slit, a circular hole, or an X will work for this particular step. Once each of the plurality of drain-receiving holes is made, each of the plurality of drains 8 is placed in and secured to the corresponding hole as described above.

Although the invention has been explained in relation to its preferred embodiment, it is to be understood that many other possible modifications and variations can be made without departing from the spirit and scope of the invention as hereinafter claimed.

What is claimed is:

1. A flow-through pool cover comprising:

a pool cover;

a plurality of drain-receiving holes;

a plurality of drains;

the pool cover comprising a top surface and a bottom surface;

each of the plurality of drains comprising a base plate, a plurality of drain holes, a tubular body and a fastening mechanism;

the plurality of drain-receiving holes being distributed across the pool cover;

each of the plurality of drain-receiving holes traversing through the pool cover from the top surface to the bottom surface;

the plurality of drain holes being distributed across the base plate;

each of the plurality of drain holes traversing through the base plate;

the tubular body of each of the plurality of drains being concentrically positioned with a corresponding hole from the plurality of drain-receiving holes;

the tubular body being adjacently positioned to the top surface;

the base plate being concentrically positioned with the tubular body;

the base plate being adjacently and perimetrically positioned to the bottom surface, around the corresponding hole;

the base plate being attached to the tubular body by the fastening mechanism through the pool cover;

the fastening mechanism comprising a plurality of screws;

each of the plurality of screws traversing through the base plate and into the tubular body without contacting the pool cover;

a plurality of pool fasteners;

the plurality of pool fasteners being perimetrically distributed about the pool cover; and each of the plurality of pool fasteners being attached to the pool cover.

2. The flow-through pool cover as claimed in claim 1 comprising:

an outlet rim of the tubular body being positioned adjacent to the top surface; and an inlet rim of the tubular body being positioned offset from the top surface.

3. The flow-through pool cover as claimed in claim 2 comprising:

a surrounding area of the top surface for each of the plurality of drains being in a taught configuration; and the surrounding area and an outer lateral surface of the tubular body forming a water retention region around each of the plurality of drains.

4. The flow-through pool cover as claimed in claim 1 comprising:

each of the plurality of drains comprising a grommet;

the grommet of each of the plurality of drains being concentrically positioned with the corresponding hole;

the grommet being sealingly engaged to the pool cover around the corresponding hole; and the grommet being compressed in between the base plate and the tubular body by the fastening mechanism.

5. The flow-through pool cover as claimed in claim 2 comprising:

a diameter of the outlet rim for each of the plurality of drains being greater than a diameter of the corresponding hole.

6. The flow-through pool cover as claimed in claim 1 comprising:

the plurality of drain-receiving holes being radially distributed about a center of the pool cover.

7. A flow-through pool cover comprising:

a pool cover;

a plurality of drain-receiving holes;

a plurality of drains;

the pool cover comprising a top surface and a bottom surface;

each of the plurality of drains comprising a base plate, a plurality of drain holes, a tubular body, a grommet and a fastening mechanism;

the plurality of drain-receiving holes being distributed across the pool cover;

each of the plurality of drain-receiving holes traversing through the pool cover from the top surface to the bottom surface;

the plurality of drain holes being distributed across the base plate;

each of the plurality of drain holes traversing through the base plate;

the tubular body of each of the plurality of drains being concentrically positioned with a corresponding hole from the plurality of drain-receiving holes;

the tubular body being adjacently positioned to the top surface;

the base plate being concentrically positioned with the tubular body;

the base plate being adjacently and perimetrically positioned to the bottom surface, around the corresponding hole;

the base plate being attached to the tubular body by the fastening mechanism through the pool cover;

the grommet of each of the plurality of drains being concentrically positioned with the corresponding hole;

the grommet being sealingly engaged to the pool cover around the corresponding hole;

the grommet being compressed in between the base plate and the tubular body by the fastening mechanism;

the fastening mechanism comprising a plurality of screws;

each of the plurality of screws traversing through the base plate and into the tubular body without contacting the pool cover;

a plurality of pool fasteners;

the plurality of pool fasteners being perimetrically distributed about the pool cover; and each of the plurality of pool fasteners being attached to the pool cover.

8. The flow-through pool cover as claimed in claim 7 comprising:

an outlet rim of the tubular body being positioned adjacent to the top surface; and an inlet rim of the tubular body being positioned offset from the top surface.

9. The flow-through pool cover as claimed in claim 8 comprising:

a surrounding area of the top surface for each of the plurality of drains being in a taught configuration; and the surrounding area and an outer lateral surface of the tubular body forming a water retention region around each of the plurality of drains.

10. The flow-through pool cover as claimed in claim 8 comprising:

a diameter of the outlet rim for each of the plurality of drains being greater than a diameter of the corresponding hole.

11. The flow-through pool cover as claimed in claim 7 comprising:

the plurality of drain-receiving holes being radially distributed about a center of the pool cover.

* * * * *